United States Patent [19]

Steiner

[11] 4,111,543

[45] Sep. 5, 1978

[54] APPARATUS AND METHOD FOR NOISE IMMUNITY IN DISTRIBUTING CONTROL SIGNALS IN ELECTROSTATOGRAPHIC PROCESSING MACHINES

[75] Inventor: Edward L. Steiner, Macedon, N.Y.

[73] Assignee: Xerox Corporation, Stamford, Conn.

[21] Appl. No.: 677,108

[22] Filed: Apr. 15, 1976

[51] Int. Cl.[2] ..... G03G 21/00

[52] U.S. Cl. ..... 355/14; 340/146.1 C

[58] Field of Search ..... 355/14; 307/DIG. 1; 178/4.1 R, 4.1 B, 17.5, 69 G; 340/146.1 BA, 146.1 C

[56] References Cited

U.S. PATENT DOCUMENTS

| | | | |
|---|---|---|---|
| 3,680,045 | 7/1972 | Meidan | 340/146.1 BA |
| 3,745,529 | 7/1973 | Engle | 178/69 G |
| 3,914,047 | 10/1975 | Hunt et al. | 355/14 |
| 3,934,131 | 1/1976 | Perschy | 340/146.1 BA |
| 3,936,600 | 2/1976 | Galbraith | 178/17.5 |
| 3,940,210 | 2/1976 | Donohue | 355/14 |
| 3,978,449 | 8/1976 | Sanders et al. | 178/69 G |
| 3,992,698 | 11/1976 | Sahasrabudhe et al. | 340/146.1 BA |

*Primary Examiner*—A. D. Pellinen

[57] ABSTRACT

Apparatus and method for transmitting signals between a data processing unit and the process stations of an electrostatographic machine. Operating signals from the data processing unit are transmitted in blocks to one or more remote interface units where the signals are stored pending use in controlling the electrostatographic processing stations. A return signal path is provided for two transmitted logic signals as a test of the integrity of the signal transmission. And in addition, a timing device is associated with the remote interface unit or units so that, in the absence of signals occurring within a predetermined period, the remote interface unit will be inactivated.

5 Claims, 3 Drawing Figures

APPARATUS AND METHOD FOR NOISE IMMUNITY IN DISTRIBUTING CONTROL SIGNALS IN ELECTROSTATOGRAPHIC PROCESSING MACHINES

This invention relates generally to electrostat graphic reproduction machines and more particularly to apparatus for improving the integrity of control signals developed in a data processing unit and transmitted to the processing stations of the electrostatographic machine Applications Ser. No. 677,109 and Ser. No. 677,110, filed Apr. 15, 1976 by the same inventor and assigned to the same assignee, are related hereto.

As electrostatographic reproduction machines have become larger and more complex, it has become advantageous to control the processing stations with a data processing unit. The use of a central processing unit has provided numerous advantages in adaptability and flexibility in the electrostatographic machine operation. Typically, the data processing unit, in response to appropriate clocking and sensor input signals, can generate control signals. The logic signals from the data processing unit actuate control circuits for the processing station apparatus. The data processing unit transmits the control signals to a location which is typically remote. Moreover, it is possible during the transmission of the logic signals that noise can jeopardize the integrity of the transmission of the control signals. Moreover, the electrostatographic reproduction machine can be a rich source of noise. For example, the corotron devices produce a varied noise spectrum as will the flash lamp current pulse.

It is known in the prior art to provide shielding for cables transmitting the logic control signals. This shielding can be both expensive and only partially successful for most practical shielding structures.

It is further known that logic signals can be encoded with additional information in the form of an error-correcting code such that the original logic signal is reconstructed after transmission. However, such encoding techniques typically involve extensive electrical apparatus to implement and can provide an unacceptable complication.

In the presence of a potentially noisy environment, sampling techniques and multiple processing of the same information with decision logic to determine statistically the most probably correct logic state resulting from a signal manipulation operation have been suggested. However the duplication of processing operations as well as the statistical decision information apparatus can provide unacceptable complications.

It is therefore an object of the present invention to provide an improved electrostatographic reproduction apparatus.

It is another object of the present invention to provide apparatus for enhancing the integrity of control signals distributed through the electrostatographic process device.

It is a more particular object of the present invention to provide for periodic transmission of control signals to all remote processing stations in electrostatographic reproduction machines.

It is another more particular object of the present invention to provide a remote interface unit associated with remote processing stations in an electrostatographic reproduction machine which accepts and stores transmitted control signals utilized to control the operation of the remote processing stations.

It is still another more particular object of the present invention to provide apparatus associated with the remote processing locations of an electrostatographic reproduction machine to inactivate the processing in the absence of the control signals transmitted in a predetermined time interval.

It is still another more particular object of the present invention to provide, in association with the image processing apparatus in an electrostatographic reproduction machine in which precise timing activation is required, apparatus for recognizing a predetermined sequence of transmitted control signals to the remote station.

It is yet another more particular object of the present invention to provide apparatus, in electrostatographic reproduction machines for providing apparatus for checking correct transmission of information to remote processing locations.

The aforementioned and other objects are accomplished according to the present invention by providing groups of instruction signals to be transmitted periodically to the remote interface units for controlling the performance of the electrostatographic processing operations. The instruction signals can be periodically updated in a data processing unit on the basis of input signal information, or on the basis of a predetermined time sequence of the instruction signals. The control signals, transmitted from the data processing unit, are received in the remote interface unit and stored therein. Logic apparatus examines the contents of the stored information and provides, in response to predetermine the combination of instruction logic signals, appropriate signals for control of the image processing apparatus associated with the remote processing station.

In the event that activation of a remote image processing device is to be performed at a predetermined time, the control signal activating the processing apparatus is transmitted following a transmission of the preselected sensitizing signal. When the sensitizing and control signals are transmitted in a pre-established time relationship, an appropriate image processing device activation signal is thereafter generated.

Apparatus is included at the remote station interface unit for automatically inactivating the remote station processing apparatus in the event that a control signal is not transmitted within a predetermined time. In addition, a return path is provided for the transmitted signals as a check against systematic errors.

These and other features of the invention will be understood upon reading the following description in conjunction with the figures which include:

Figure 1:
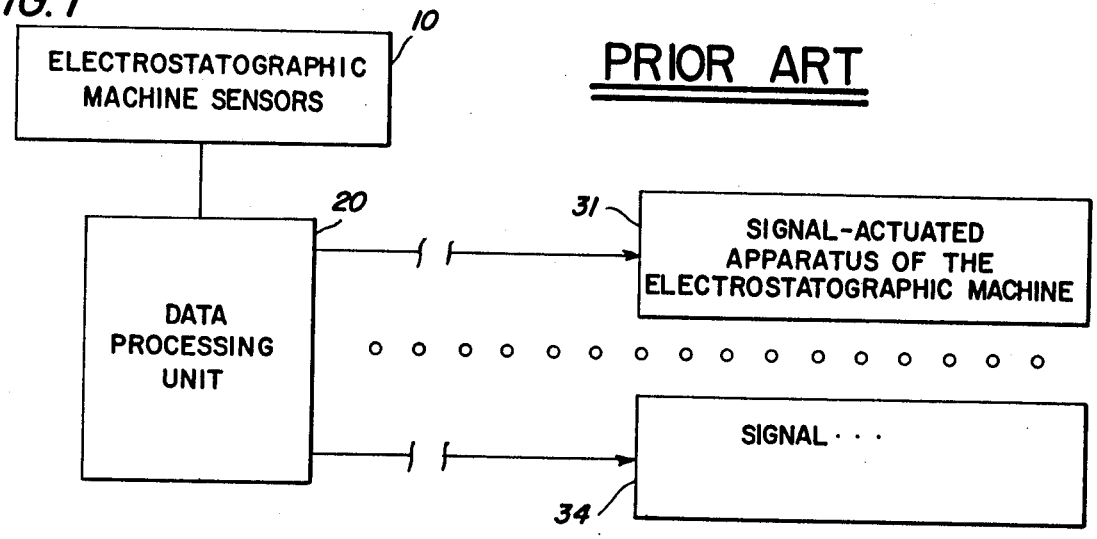
FIG. 1 is a schematic diagram of the apparatus controlling the processing stations of an electrostatographic machine according to the prior art.

Referring now to FIG. 1, a schematic diagram of a system for controlling the processing stations of an electrostatographic reproduction machine by means of a data processing unit, according to the prior art is shown. A data processing unit 20 receives input signals from the electrostatographic machine sensors 10. The input signals can be status signals, signals identifying a position of a copy sheet, clocking signals derived from the machine components, fault condition signals or any other signal which can be utilized to control the machine processing stations. On the basis of the input signals, the data processing unit 20 produces appropriate control signals which are applied to signal actuated apparatus 31 through 34 of the electrostatographic machine processing stations. The signal actuated apparatus 31 through 34 can include solenoids, flash lamps, etc and the electronic circuits actuating these components. The processing stations can include sorters, paper handling devices and devices for which the operation should be determined by the actual image processing of the electrostatographic machine.

As discussed above, certain components of electrostatographic reproduction machine such as the corotrons and the flash lamps, provide a rich source of electromagnetic noise. This noise can enter the system shown in FIG. 1 by several paths. The machine sensors 10 can provide erroneous output signals in the presence of noise and the integrity of the sensor output signals as applied to data processing unit 10 can be jeopardized by noise entering the electrical connections coupling the sensors and the data processing unit. Similar, the integrity of the control signal applied from the data processing unit 20 to the signal actuated apparatus 31 through 34 can be impaired. But more importantly, the integrity of the data processing unit can be jeopardized by electromagnetic noise. For example, the logical manipulation by the data processing unit of the input signals necessary for determination of the processing station operation can be vulnerable to noise. And as the data processing unit becomes increasingly dependent on stored programs capable of being electrically altered for greater operational flexibility, the accuracy of the stored control program can be impaired.

Figure 2:
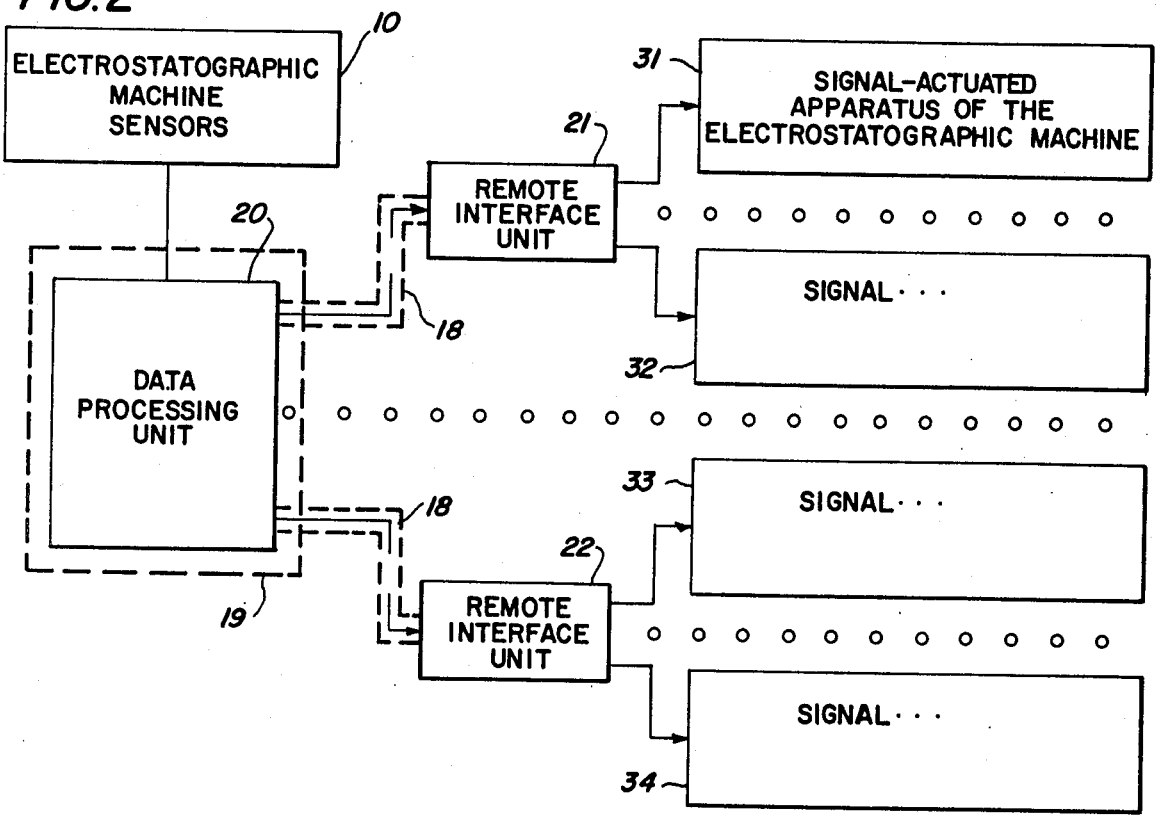
FIG. 2 is a schematic diagram of the apparatus controlling the processing stations of an electrostatographic machine according to the present invention.

Referring next to FIG. 2, a schematic diagram of a system for controlling the processing stations of an electrostatographic reproduction machine by means of a data processing unit, according to the present invention is shown. The data processing unit 20 receives input signals from the electrostatographic machine sensors 10. However, instead of delivering control signals directly to the signal actuated apparatus, instruction signals are delivered to remote interface units, 21 through 22. The instruction signals are decoded by the apparatus of the remote interface unit, thereby obtaining control signals which are applied to the signal actuated apparatus of the electromagnetic machine.

In this system, the data processing unit 20 can be shielded from the electromagnetic noise generated by components of the reproduction machine. This shielding can take the form of an appropriate material (indicated by covering 19 in FIG. 2). The coupling of logic signals into and out of data processing unit 20 can be accomplished by electro-optic elements, thereby eliminating direct electrical coupling to the data processing unit. Shielding can also be accomplished by removing the data processing unit to a distance from the reproduction operating components for which the resulting electromagnetic noise is sufficiently diminished for accurate operation of the data processing unit. In this manner, the operation of the data processing system can be rendered more reliable.

In an effort to increase the accuracy of the input signals, the data processing unit can sample the input signals and by appropriate logic apparatus, can statistically determine the most probable logical state of an input signal.

The remote interface unit can be equipped with apparatus to store the instruction signals. Accurate transfer of the instruction signals between the data processing unit 20 and the remote interface units can be enhanced by several methods. The electrical couplings between the data processing unit and the remote interface units 21 through 22 can be shielded. Accuracy of instruction signal transfer can be enhanced by having the instruction signals encoded by the data processing unit in a format which can tolerate the presence of noise, i.e. in an error correcting code, and by having appropriate decoding apparatus in the remote interface units. Accuracy of instruction signal transfer can be enhanced by the addition of electrical couplings from the remote interface unit to the data processing unit and the addition of apparatus for periodically integrating the instruction signals stored in the remote interface unit. A still further method of enhancing the accuracy of the instruction signals stored in the remote interface unit is to refresh these instruction signals periodically, thereby correcting and errors which can occur due to noise. Finally, the remote interface unit, themselves can be shielded, if necessary, to increase the reliability of signals entered into the remote interface units.

Because the remote interface units are located, in the preferred embodiment, relatively close to the related signal actuated apparatus, the shortened electrical couplings provide relative immunity to noise induced by electromagnetic radiation as compared to the longer electrical couplings.

Figure 3:
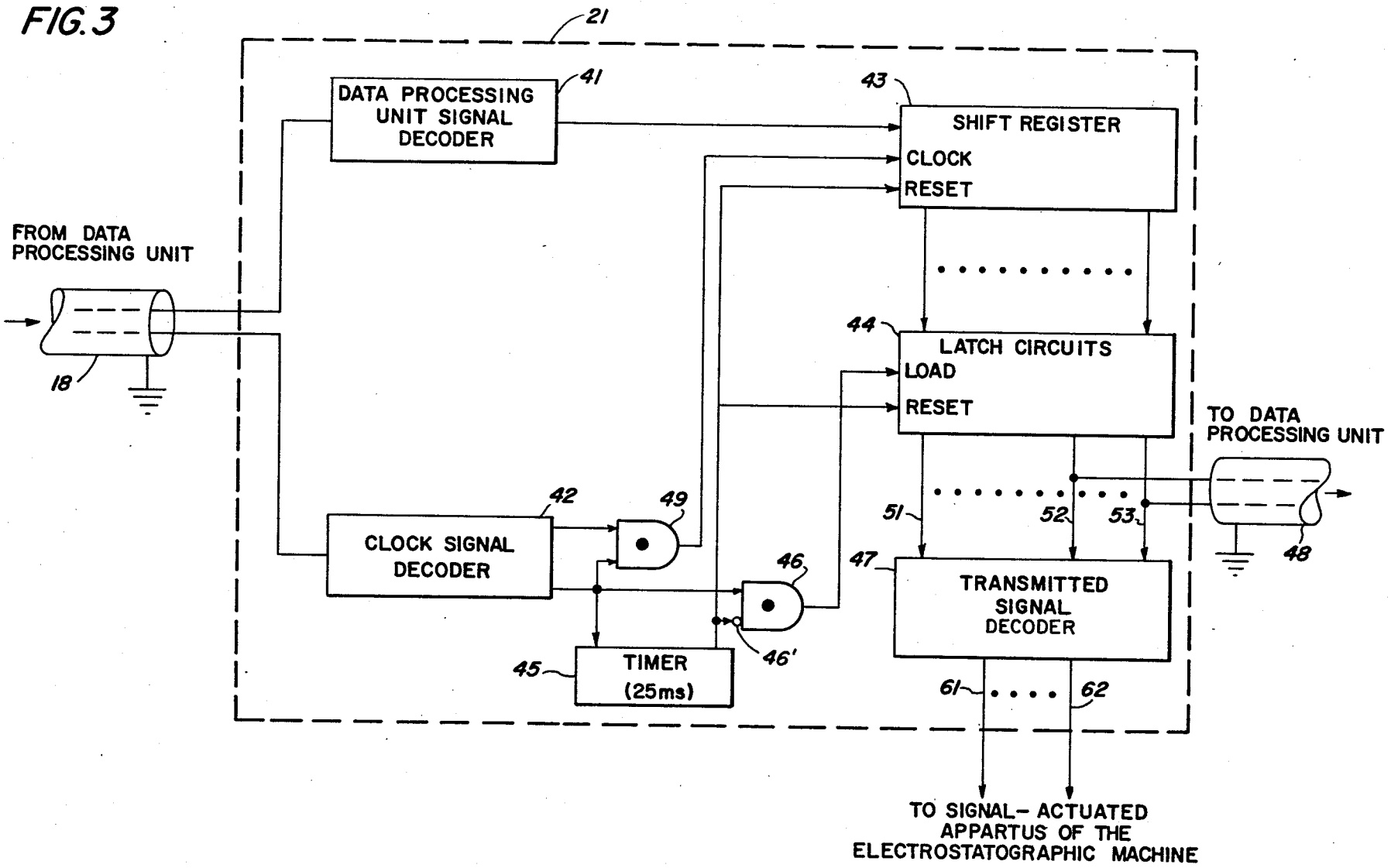
FIG. 3 is a schematic diagram of the remote interface unit utilized in controlling processing stations of an electrostatographic machine.

Referrring next to FIG. 3, a schematic diagram of the apparatus comprising the remote interface unit according to the preferred embodiment is shown. The data processing unit applies two sets of signals to a remote interface unit (21), a clocking signal and the instruction signal. The instruction signals contain logical signals which have encoded information containing the control of the signal actuated reproduction machine. Each clocking signal is sent with a slight delay after the transmission of an instruction signal. The clocking signal sequence has a precursor signal applied to clock signal decoder 42. The precursor signal applies an enabling logic signal to a first input terminal of logic AND gate 49, an enabling logic signal to a first input terminal of logic AND gate 46 and a logic signal to timer 45.

Timer 45 is a safety device and a negative logic signal normally appears at the output terminal of timer 45. A signal inverting stage 46' associated with a second terminal of logic AND gate 46 enables gate 46. However, should a clocking pulse not be applied to the input terminal of timer 45, a positive pulse will be applied but the output terminal of timer 45, disabling gate 46 and resetting shift register 43. Timer 46 must be reactivated before data can be entered in the latch circuits.

After the precursor pulse, positive logic (clocking) signals are transmitted. Immediately before each of the clocking signals an instruction signal is applied to the data processing unit signal decoder 41. The data decoding unit, after determining whether the applied signal indicates a positive or negative logic signal, applies the appropriate logic signal to an input terminal of shift register 43. The delayed clocking signal is applied through clock signal decoder 42, through enabled gate 49 to the clock terminal of shift register 43. Thus, the logic instruction signals are entered and shifted in the shift register. In the preferred embodiment, the instruction signal contains information relating to 40 logic signals and shift register 43 has 40 elements. During the loading of the logic signals in shift register 43, gate 46 applies a logic signal to latch circuits 44. Latch circuits 44 then receive the signals from the shift register 43 and after the transmission of the group of instruction signals, the positive logic signal is removed from the first input terminal of gate 46 to terminate storing of the logic signals from register 43 in the latch circuits 44.

The logic signals stored in latch circuits 44 are fed via channels 51 through 53 to transmitted signal decoder 47. The signal decoder identifies predetermined patterns of logic signals in the latch circuits and in response provides appropriate signals to electrical couplings 61 through 62. The signals applied to couplings 61 through 62 control the associated signal actuated apparatus.

To provide partial verification of the integrity of the transmitted logic signals, the logic signals from two data positions, indicated in FIG. 3 by latch circuit electrical couplings 52 and 53, are returned to the data processing unit 20 via electrical coupling 48. The data position pair are dedicated, in the preferred embodiment to this checking function. One data position is arbitrary, with a negative logic signal while the other data position, represented by coupling 53 represents a logic signal that was shifted the length of shift register 43.

It will be understood by those skilled in the art that when the transmitted signal decoder 47 is activating a mechanical device, the inertia associated with the mechanical device will prohibit response to occasional errors in the signal. Thus, even in the presence of noise, which may be sufficient to generate errors in the control signals, these errors will have minimal effect on operation. The use of synchronized clocking signals with instruction signal transmission also enhances noise immunity.

It will be further understood that for some machine devices, where relatively precise activation is required, such as a flash lamp, the present apparatus envisions a two stage process. A series of sensitizing signals is first transmitted to the apparatus. The sensitizing signal prepares the apparatus to be triggered by a succeeding trigger signals. In the presence of noise, the operation is as follows. One of the series of sensitizing signals will prepare the apparatus for response to the trigger signals. Only one of the series of sensitizing signals has to be error free to sensitize the apparatus. Error free trigger signals will provide an accurate device activation. In the presence of noise the device activation can be early or late. However, because the number of repetition rate of the sensitizing signals and trigger signals, the resulting copy will be acceptable. For example, in the case of the flash lamp excitation, the register of the copy on the copy sheet will have a displacement, which except in critical circumstances will not be noticeable.

The above description is included to illustrate the operation of the preferred embodiments and is not meant to limit the scope of the invention. The scope of the invention is to be limited only by the following claims. Many variations will be apparent to one skilled in the art that would yet be encompassed by the spirit and scope of the invention.

What is claimed is:

1. A method for operating the processing stations of an electrostatographic reproduction unit under control of a data processing unit comprising the steps of:

periodically sending a block of control information signals from said data processing unit to a remote unit;

storing said block of control information signals in said remote unit;

removing said block of control information signals and decoding said control information signals to provide control signals for the processing stations of said reproduction unit associated with said remote unit; and applying said control signals to said processing stations of said reproduction unit associated with said remote unit.

2. The method of claim 1 including the steps of storing control information signals in said remote unit in response to clocking signals, and alternating said control information signals with said clocking signals when sending control information signals to said remote unit.

3. The method according to claim 2 including the step of sending a precurser signal before said control information signals to ready said remote unit for receipt of the next block of said control information signals.

4. A system for controlling processing stations of an electrostatographic machine comprising:

at least one remote interface unit, said interface unit applying control signals from instruction signals to processing stations associated with said remote interface unit and including signal storing means for storing a preset block of said instruction signals for application as said control signals; and a data processing unit, said data processing unit in at least partial response to an operational status of said electrostatographic machine periodically transmitting said preset block of instruction signals to said remote interface unit, said remote interface unit including apparatus for deriving said control signals from said instruction signals stored in said remote interface unit.

5. The system for controlling an electrostatographic machine in claim 3 including timing means for inactivating said signal storing means on a predetermined interruption during transmittal of said instruction signals.

* * * * *